US006029818A

United States Patent [19]

Kumakura et al.

[11] Patent Number: 6,029,818

[45] **Date of Patent: *Feb. 29, 2000**

[54] MERCHANDISE PACKAGE WITH RELEASABLE BONDED COLLAR PART

[75] Inventors: Katsuhiko Kumakura, Kyoto Pref.; Tadashi Ono, Hirakata, both of Japan

[73] Assignee: Matsushita Electric Industrial Co., Ltd., Osaka-fu, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/004,742

[22] Filed: Jan. 8, 1998

Related U.S. Application Data

[63] Continuation of application No. 08/643,684, May 6, 1996, Pat. No. 5,735,404.

[30] Foreign Application Priority Data

May 11, 1995 [JP] Japan ..... 7-113420
Dec. 12, 1995 [JP] Japan ..... 7-323262

[51] Int. Cl.[7] ..... B65D 85/88

[52] U.S. Cl. ..... 206/469; 206/705

[58] Field of Search ..... 206/461–471, 206/459.5, 497, 531, 532, 704, 705; 493/63, 73

[56] References Cited

U.S. PATENT DOCUMENTS

| | | | |
|---|---|---|---|
| 3,382,972 | 5/1968 | Phipps . | |
| 3,428,171 | 2/1969 | Blish | 206/469 |
| 3,599,787 | 8/1971 | Webster, Jr. . | |
| 3,685,648 | 8/1972 | Heller . | |
| 4,311,234 | 1/1982 | Wildgoose . | |
| 4,803,048 | 2/1989 | Nason . | |
| 4,971,197 | 11/1990 | Worley . | |
| 5,052,992 | 10/1991 | Hyder . | |
| 5,188,231 | 2/1993 | Kivell et al. . | |
| 5,311,989 | 5/1994 | Ward et al. . | |
| 5,429,233 | 7/1995 | Juaristi . | |
| 5,579,910 | 12/1996 | Bennett . | |

FOREIGN PATENT DOCUMENTS

| | | |
|---|---|---|
| 63-299049 | 12/1988 | Japan . |
| 2-278655 | 11/1990 | Japan . |
| 2003819 | 3/1979 | United Kingdom . |

*Primary Examiner*—Jim Foster
*Attorney, Agent, or Firm*—Akin, Gump, Strauss, Hauer & Feld, L.L.P.

[57] ABSTRACT

A merchandise package includes a mounting board and a holding part for holding articles in cooperation with the mounting board. The mounting board has first and second opposite side edges and a third edge extending therebetween. The mounting board includes two perforations formed therein which extend away from the third edge into the mounting board. A peripheral region is defined between each of the perforations and the respective first and second opposite side edges. The holding part includes a dent for containing the articles, and a collar part which is bonded to the mounting board in at least the peripheral region. The collar part includes a cut line which defines a detachable portion of the collar part. The cut line is located between the two perforations at an edge of the collar part. The detachable portion is also bonded to the mounting board. The cut line allows the detachable portion to release from the collar part and remain bonded to the mounting board when the merchandise package is opened. The release of the detachable portion from the collar part causes a cut-out part to be formed in a lower end part of the collar part.

9 Claims, 12 Drawing Sheets

MERCHANDISE PACKAGE WITH RELEASABLE BONDED COLLAR PART

CROSS REFERENCE TO RELATED APPLICATION

This application is a continuation of application Ser. No. 08/643,684, filed May 6, 1996, U.S. Pat. No. 5,735,404 entitled "MERCHANDISE PACKAGE AND METHOD OF MANUFACTURING THE SAME", the entire disclosure of which is incorporated herein by reference.

FIELD OF THE INVENTION AND RELATED ART STATEMENT

1. Field of the Invention

The present invention relates to a merchandise package for packing and exhibiting small articles such as batteries for selling them, and a method of manufacturing the same.

2. Description of the Prior Art

In recent years, as a merchandise package for packing daily miscellaneous goods such as batteries and toiletries or processed food, a blister package is widely used because of an exhibition effect at stores and cheap cost. In the blister package, a dent or dents are thermally formed in a transparent synthetic resin sheet, and an article or articles are packed in the dent. A peripheral part surrounding the dent is bonded to a mounting board such as a paper board, so that an opening of the dent is closed and the article is held.

As an example of a conventional merchandise package, a battery package for packing batteries will be explained with reference to FIG. 16 and FIG. 17.

FIG. 16 is a front view showing a conventional battery package. FIG. 17 is an exploded perspective view showing the conventional battery package shown in FIG. 16.

In FIG. 16, a conventional battery package 51 comprises a mounting board 52 formed by a paper board, and a holding part 53, which is formed by a transparent synthetic resin sheet, for packing a plurality of, for example four, batteries 40. In order to hang the battery package 51 by means of a pin or the like at a store, the mounting board 52 has a hanging hole 52*a*. Perforations 52*b* is formed in the mounting board 52 so as to surround an opening of the below-mentioned dent 53*a* with a lower edge of the mounting board 52. In order to open the battery package 51, a cutting part 52*c* (FIG. 17) defined by the perforations 52*b* and the lower edge of the mounting board 52 is separated from the mounting board 52, so that the batteries 40 can be taken out from the battery package 51 (as described in detail later).

The holding part 53 comprises a dent 53*a* for containing the batteries 40 arranged parallel to each other in a horizontal direction, a collar part 53*b* disposed around the opening of the dent 53*a* and to be bonded to the mounting board 52, and a pair of leg parts 53*c* disposed to a lower end of the dent 53*a*.

The dent 53*a* and the leg parts 53*c* are formed by thermoforming a sheet-like shaped synthetic resin with a metal mold. In order to put the batteries 40 into the dent 53*a* easily, the outer shape of the dent 53*a* is formed larger than the outer shape of the batteries 40 by some margins around the outer shape of the batteries 40. A bottom surface of the leg parts 53*c* flushes with the lower edge of the mounting board 52. Therefore, the battery package 51 can stand upright at the bottom surface of the leg parts 53*c* and the lower edge of the mounting board 52 for the purpose of exhibition.

As shown in FIG. 17, after putting each one of the batteries 40 by hand into the holding part 53 positioned downward, the mounting board 52 and the collar part 53*b* are bonded to each other by a hot pressing machine with a heat sensitive and pressure sensitive adhesive. Thereby, the battery package 51 is completed.

During a packing operation of the batteries 40, a facing operation is performed in which the four batteries 40 are directed to the same direction and packed into the dent 53*a*. That is, in general, on the outer peripheral surface of each battery 40, there is a space or part which displays the type, the grade, the manufacturer's name and the like of the battery 40 (hereinafter referred to as a "front face"). Each one of the batteries 40 is put into the dent 53*a* in such a manner that the front face is directed to the front side of the battery package 51 in the facing operation.

As has been explained in the above, the mounting board 52 has the cutting part 52*c* defined by the perforations 52*b* and the lower edge of the mounting board 52. The cutting part 52*c* holds the batteries 40 with the dent 53*a* substantially. The cutting part 52*c* is formed a little larger than the opening of the dent 53*a*. A lower end portion of the cutting part 52*c* is bonded to the collar part 53*b*.

When a customer, a seller or the like wants to open the conventional battery package 51, he must inserts his nail between the collar part 53*b* and a lower edge 52*c*1 of the cutting part 52*c*. Successively, he strips the lower end portion of the cutting part 52*c*, which is bonded to the collar part 53*b*, away from the collar part 53*b*. Thereafter, he holds the lower end portion of the cutting part 52*c*, and tears the perforations 52*b* from the lower end side of the mounting board 52. As a result, the cutting part 52*c* is separated from the mounting board 52, and the dent 53*a* is opened.

Thus, when the customer or seller wishes to take the article packed in the conventional merchandise package, he must remove the adhesion between the collar part and the lower end portion of the cutting part, and tears the perforations from the lower end side of the mounting board. Thereby, he opens the dent by separating the cutting part from the mounting board, and the article can be taken out the conventional merchandise package.

In the conventional merchandise package, as has been explained in the above, each one of the batteries is packed into the dent with the facing operation. Such packing operation including the facing operation has been difficult to automatize, and the packing operation has been manually performed. Therefore, there is a problem that the packing operation takes a long time. Furthermore, there is a possibility that rust is made on the batteries by adhesion contamination with sweat from hands and fingers in the packing operation.

Furthermore, the outer shape of the dent is formed larger than the outer shape of the batteries. Thereby, after packing the batteries into the battery package, the batteries can and make individual rotation in the dent at vibration or the like during transportation. Accordingly, there is a possibility that visual confirmation of the type, the grade, the manufacturer's name and the like of the batteries becomes difficult, because all front faces can not be visually confirmed and/or the front faces are put to various different directions with each other.

As a countermeasure for preventing rotation of the batteries, for example, Japanese examined Patent publication Hei No. 6-79476 discloses that plural small projections projecting toward the mounting board are formed inside of the dent. That is, in the conventional battery package, each one of the batteries is held and fixed between the plural small projections in the dent, so that all front faces are fixed to the front side of the battery package.

However, in the conventional battery package having the small projections, the operability of packing the batteries is low because of the plural small projections. Thereby, there is a problem that work hour of the packing operation is inevitably long. Furthermore, it is necessary to form the dent into a complex configuration, so that the holding part needs to be formed with a high processing accuracy.

Furthermore, in the conventional merchandise package, the lower end portion of the cutting part, namely, the cutting start part of the cutting part is adhered to the collar part by the adhesive. Therefore, when the conventional merchandise package is opened, it is necessary to strip away the bonded part between the cutting start part and the collar part by an insertion of the nail or the like therebetween. Hence, there is a problem that opening of the conventional merchandise package takes time and labor.

Moreover, since the cutting part is formed larger than the opening of the dent, it is difficult to keep the unused batteries in the conventional merchandise package after once opening the conventional merchandise package. For example, if the once opened the conventional merchandise package still containing some articles therein is hung to a pin with the hanging hole, there is a possibility that the articles, e.g. unused batteries may fall off from the dent.

Moreover, since the batteries are packed without individual sealing, there is a possibility that rusts is generated on terminal parts of the unused batteries by sticking of sweat from finger or the like. As a result, there is a problem that the quality of the unused batteries is deteriorated. Furthermore, if a used article would happen to be inserted by mischief into a conventional merchandise package which is being exhibited, it is impossible to judge whether this article is a used article.

Thus, after the conventional merchandise package is opened, the maintainability of the article deteriorates, and it is impossible to guarantee that the article left in the conventional merchandise package is a new article.

OBJECT AND SUMMARY OF THE INVENTION

The object of the present invention is to provide such a merchandise package for packing articles that can solve the aforementioned problems.

In order to achieve the above-mentioned object, a merchandise package for packing articles in accordance with the present invention comprises:

a mounting board, a packing part including a substantially transparent plastic shrink-packing film for containing therein at least an article, and a holding part having a dent for containing the packing part and a collar part to be bonded to the mounting board, the holding part holding the packing part in cooperation with the mounting board.

According to the merchandise package of the present invention, the packing part is constituted with the shrink-packed articles and the packing part is contained in the holding part, so that a packing operation of the articles is almost automatized. Furthermore, the articles are shrink-packed. Thereby, even after packing of the articles in the merchandise package, rotation of the articles is prevented. As a result, visual confirmation of the type, the grade, the manufacturer's name and the like of the articles is obtainable without any inconvenience.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF THE DRAWINGS

FIG. 11 is a rear view showing a state after the battery package of FIG. 8 is opened.

FIG. 12 is a rear view showing a battery package in a seventh example of the present invention.

FIG. 13A is a rear view showing a state after opening the battery package of FIG. 12.

FIG. 13B is a side view showing a state after opening the battery package of FIG. 12.

FIG. 14 is a rear view showing a battery package in an eighth example of the present invention.

FIG. 15A is a perspective view showing a battery package in a ninth example of the present invention.

FIG. 15B is an enlarged cross sectional view, which is taken on line XVB—XVB, showing the battery package of FIG. 15A.

FIG. 16 is a front view showing a conventional battery package.

FIG. 17 is an exploded perspective view showing conventional battery package is shown in FIG. 16.

DESCRIPTION OF THE PREFERRED EMBODIMENTS

Hereafter, preferred embodiments of the present invention are described with reference to the accompanying drawings.

As an example of the merchandise packages of the present invention, a battery package for packing batteries will be described.

FIRST EXAMPLE

Figure 1:
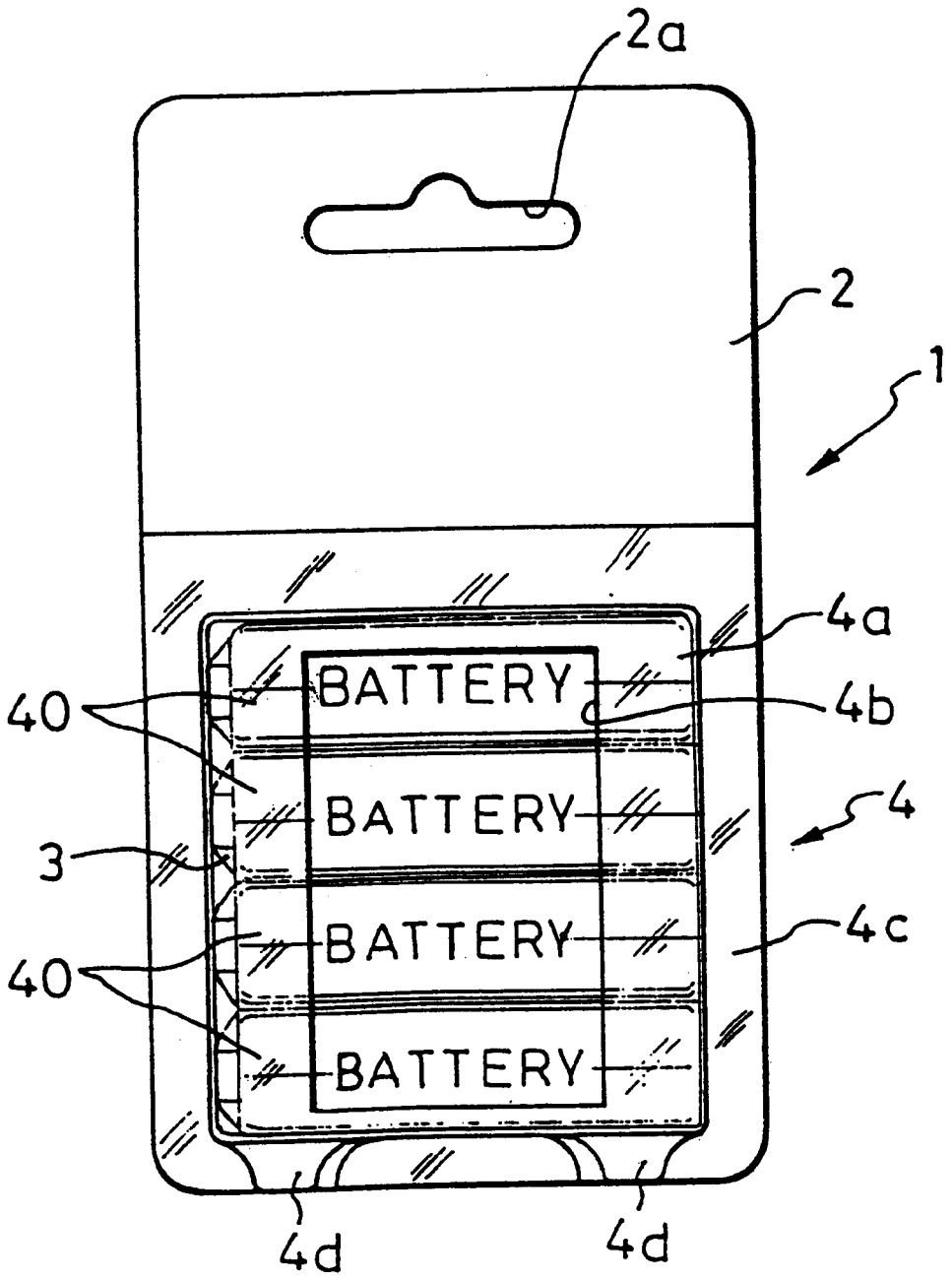
FIG. 1 is a front view showing a battery package of a first example of the present invention.
Figure 2:
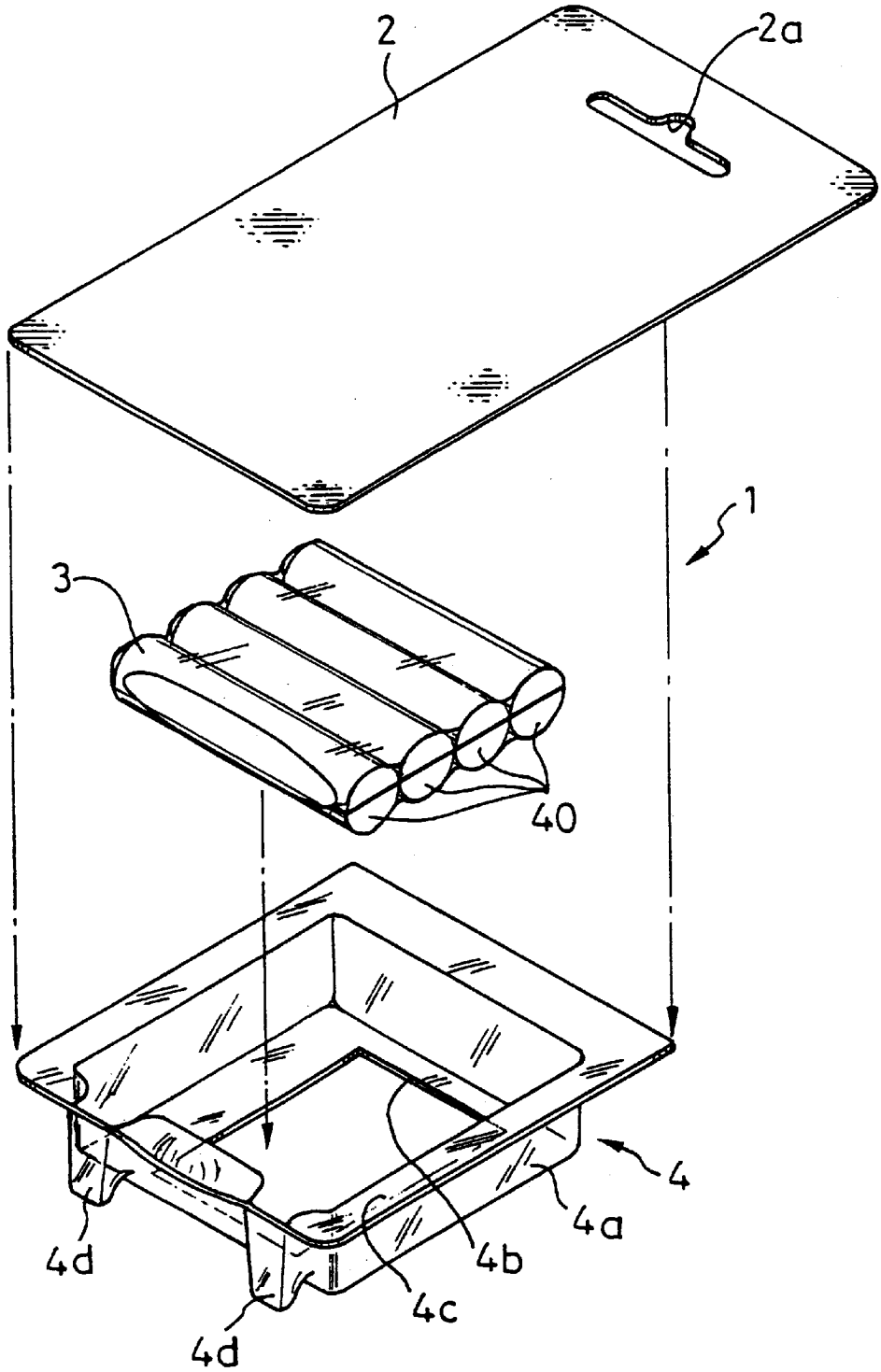
FIG. 2 is an exploded perspective view showing the battery package shown in FIG. 1.

FIG. 1 is a front view showing a battery package of a first example of the present invention. FIG. 2 is an exploded perspective view showing the battery package shown in FIG. 1.

In FIG. 1, the battery package 1 comprises a mounting board 2 of a paper board, a packing part 3 made of a transparent synthetic resin in which a plurality of, for example four, batteries 40 are shrink-packed parallel to each other, and a holding part 4 for containing and holding the packing part 3 in cooperation with the mounting board 2. In order to hang the battery package 1 on a pin in a store, the mounting board 2 has a hanging hole 2*a*. In a shrink-package forming the packing part 3, it is known that plural, for example four, batteries 40 are fixed and sealed integrally, so that they are generally sold at one time. The quality of the batteries 40 is not deteriorated since the shrink-package is not opened before selling. A shrink-packing process is directly linked to an end part of a production line for manufacturing the batteries 40. In the end part of the production line, the batteries 40 which are transported in a line so that each of the negative poles of the batteries 40 is put down. Furthermore, in the end part of the production line, photoelectric tube detection is made on the batteries 40, whereby a part of each battery 40 which displays the type, the grade, the manufacturer's name and the like of the battery 40 (hereinafter referred to as a "front face") is detected. The batteries 40 are transported with the front face directed to one direction which is perpendicular to the direction of transportation. Therefore, in the packing part 3, the four batteries 40 are shrink-packed with the front faces directed to the same direction. As a result, when the packing part 3 is put into the below-mentioned dent 4*a*, a facing operation to direct all front faces to the front side of the battery package 1 can be performed easily. Thereby, it is possible to pack the batteries 40 quickly. Furthermore, the batteries 40 are tightly shrink-packed with all front faces in the same direction and fixed to each other. Thereby, the batteries 40 do not rotate in the battery package 1 after packing in the battery package 1. As a result, visual confirmation of the type, the grade, the manufacturer's name and the like of the batteries can be realized without any trouble.

The holding part 4 comprises the dent 4*a* for containing the packing part 3, a window part 4*b* in which the dent 4*a* is formed in a rectangular shape of a predetermined size, a collar part 4*c*, which is disposed around the dent 4*a*, for bonding to the mounting board 2, and a pair of leg parts 4*d* disposed to a lower end of the dent 4*a*. The outer shape of the dent 4*a* is formed larger than the outer shape of the packing part 3 in order to put the packing part 3 into the dent 40 easily. The window part 4*b* is disposed on the front side of the battery package 1. As a result, it is possible to reduce a surface area which covers the packing part 3 of the holding part 4. Thereby, a customer can clearly confirm the type, the grade, the manufacturer's name and the like of the batteries. Furthermore, a bottom surface of the leg parts 4*d* flushes with a lower edge of the mounting board 2. Therefore, the battery package 1 can stand upright at the bottom surface of the leg parts 4d and the lower edge of the mounting board 2 for the purpose of exhibition.

As shown in FIG. 2, the packing part 3 is put into the dent 4*a* of the holding part 4 placed downward by hand so that the front faces are directed to the front side of the battery package 1. Thereafter, the mounting board 2 and the collar part 4*c* are bonded to each other by a hot press machine with a heat sensitive and pressure sensitive adhesive. Thereby, the battery package 1 is completed.

Apart from the aforementioned explanation, wherein the four batteries 40 are packed and held into the battery package 1 in a lying position as shown in FIG. 1, an alternative construction may be such that the four batteries 40 are packed and held into the battery package 1 in a standing position.

Furthermore, apart from the aforementioned explanation, wherein the front faces of the four batteries 40 are directed to the same direction, an alternative construction may be such that four outer peripheral surfaces, which are arranged on the front side of the battery package 1, of the four batteries 40 may be combined to each other so that the type, the grade, the manufacturer's name and the like of the batteries 40 are displayed.

SECOND EXAMPLE

Figure 3:
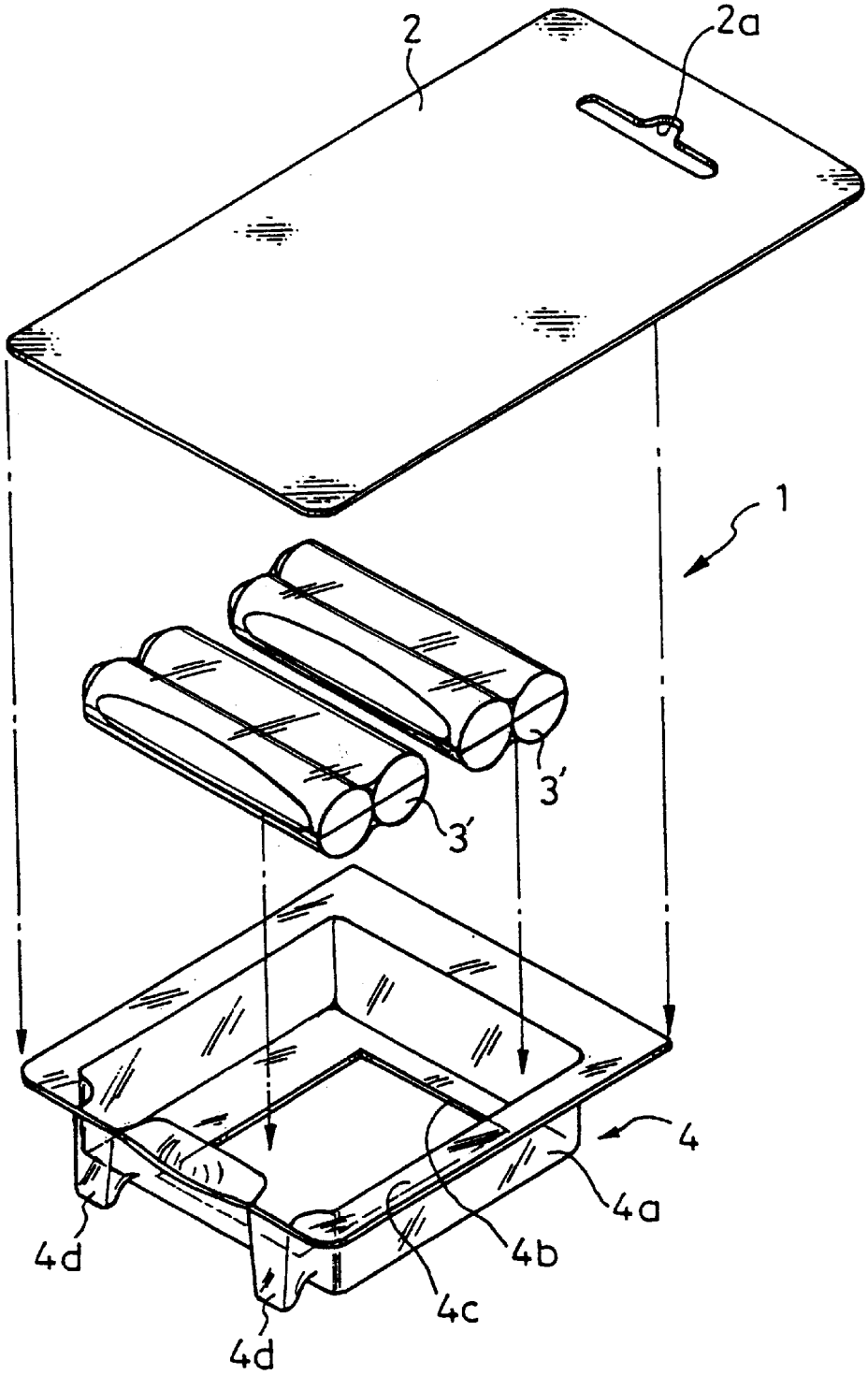
FIG. 3 is an exploded perspective view showing a battery package of a second example of the present invention.

FIG. 3 is an exploded perspective view of a battery package in a second example of the present invention. In this second example, the battery package 1 is fundamentally the same as that of the first example except for the packing part. Therefore, corresponding parts and components to the first example are shown by the same numerals and marks, and the description thereon made in the first example similarly apply. In the following description, differences of this second example from the first example are mainly explained. There are differences that two packing parts 3' each shrink-packing two batteries 40 are used instead of the packing part 3 (FIG. 2) shrink-packing four batteries 40.

As shown in FIG. 3, the two packing parts 3' are disposed into the dent 4*a* in two-stage. As a result, when only two or less batteries 40 are used, only one of the two packing parts 3' may be opened. Thereby, the quality of unused batteries 40 can be maintained, and it is possible to recognize the unused batteries 40 easily. Furthermore, one battery 40 may be shrink-packed to form the packing part.

THIRD EXAMPLE

Figure 4A:
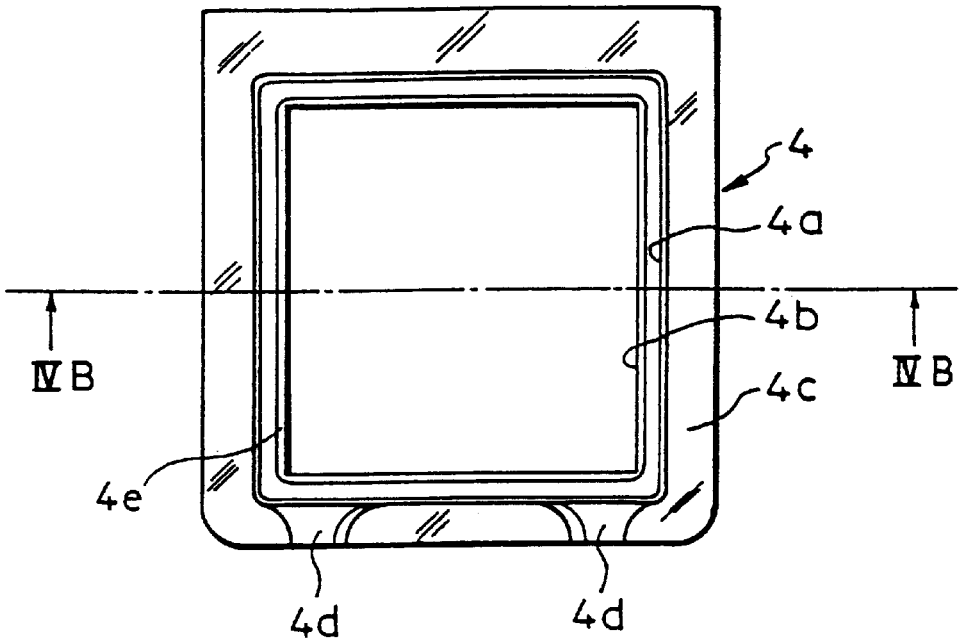
FIG. 4A is a front view showing a holding part in a third example of the present invention.
Figure 4B:
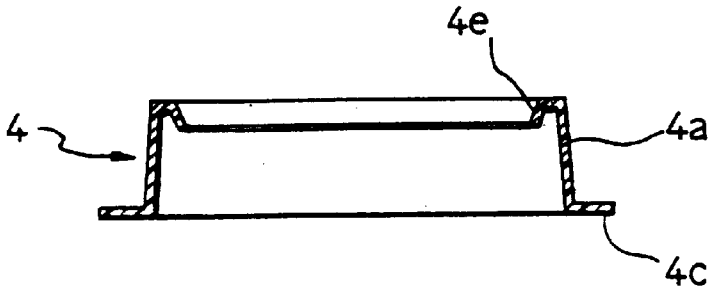
FIG. 4B is a cross sectional view, which is taken on line IVB—IVB, showing the holding part of FIG. 4A.
Figure 5:
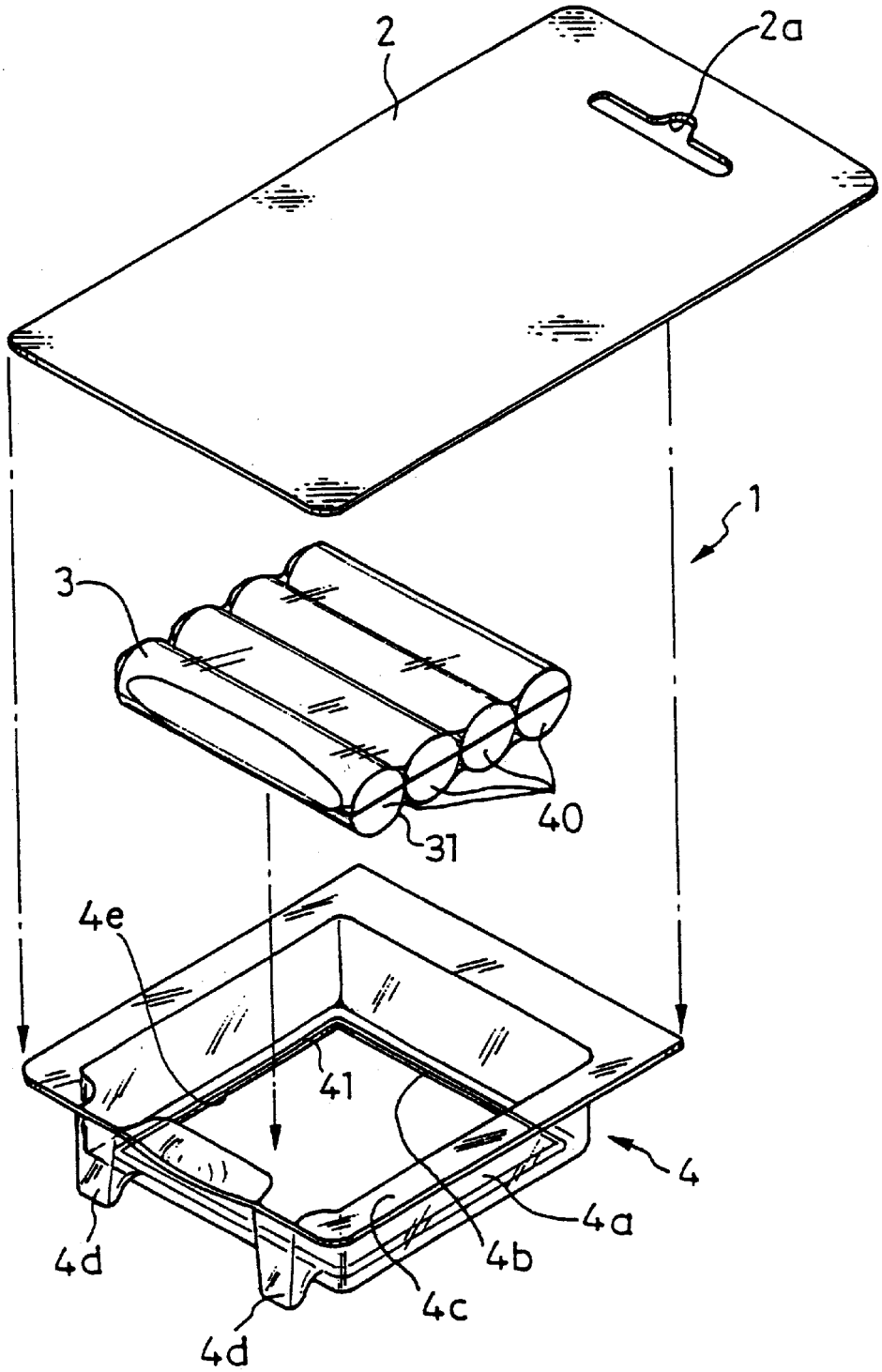
FIG. 5 is an exploded perspective view showing the battery package of the third example of the present invention.

FIG. 4A is a front view showing a holding part in a third example of the present invention, and FIG. 4B is a cross sectional view, which is taken on line IVB—IVB, showing the holding part of FIG. 4A. FIG. 5 is an exploded perspective view of the battery package in the third example of the present invention. In this third example, the battery package 1 is fundamentally the same as that of the first example except for the holding part. Therefore, corresponding parts and components to the first example are shown by the same numerals and marks, and the description thereon made in the first example similarly apply. In the following description, differences of this third example from the first example are mainly explained. There are differences that the dent 4*a* includes a folded part 4*e*.

As shown in FIGS. 4A and 4B, the folded part 4*e* is formed by folding the end part of the dent 4*a* at a periphery of the window part 4*b* from the front side of the battery package 1 toward inside of the dent 4*a*. As a result, the folded part 4*e* is formed at the periphery of the window part 4*b*. Thereby, it is possible to increase the strength of the dent 4*a* at the front side of the battery package 1. As a result of the strengthened front side, an opening of the window part 4*b* can become larger in comparison with that of the first example. A top edge of the folded part 4*e*, that is, a cut edge of the 4*b* is directed toward the inside the dent 4*a* of the battery package 1. Thereby, there is no fear of scratching fingers, laceration, etc. of the finger tip by the cut edge.

Furthermore, as shown in FIG. 5, when the packing part 3 is contained in the dent 4*a*, the packing part 3 is contained and held between the mounting board 2 and the folding part 4*e* so that the outer surface of the packing part 3 is mounted on the top edge of the folded part 4. As a result, the packing part 3 is held inside the dent 4*e* with its packed face 31 offset from the front end of the battery package 1 by a distance between an end tip 41 of the folded part 4*e* and the window part 4*b*. Thereby, it is possible to prevent the shrink package of the packing part 3 from getting tore by a nail or the like in comparison with that of the first example.

FOURTH EXAMPLE

Figure 6:
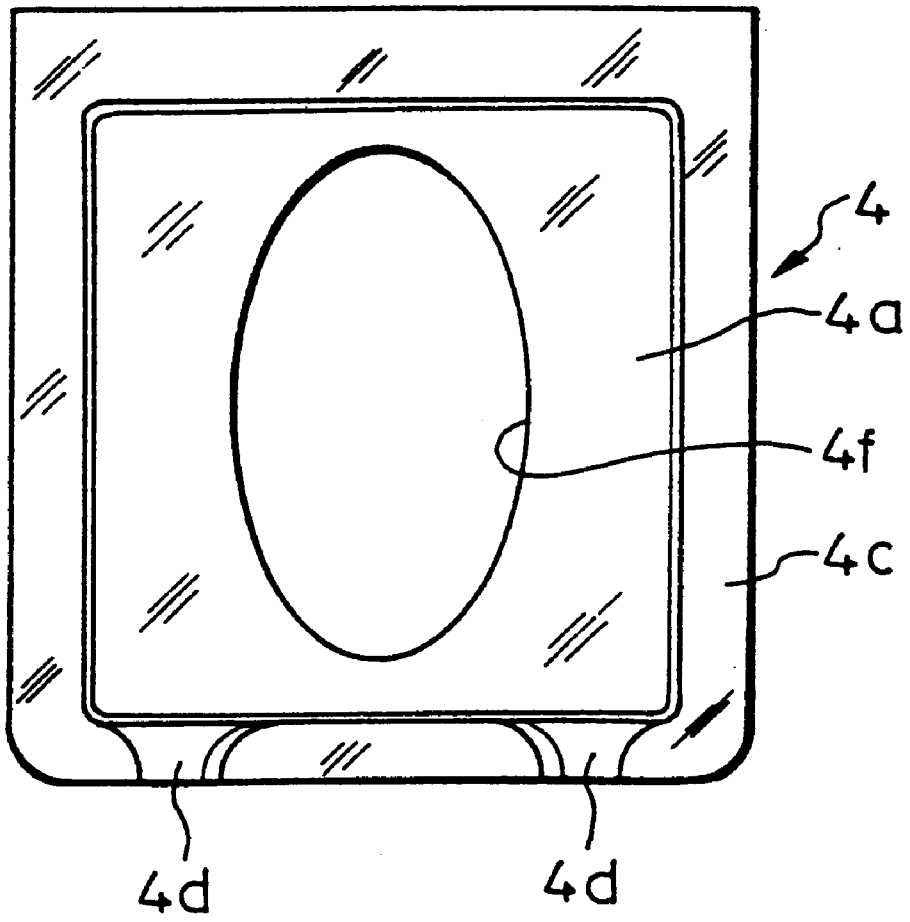
FIG. 6 is a front view showing a holding part of a battery package in a fourth example of the present invention.

FIG. 6 is a front view showing a holding part of a battery package in a fourth example of the present invention. In this fourth example, the battery package 1 is fundamentally the same as that of the first example except for the window part. Therefore, corresponding parts and components to the first example are shown by the same numerals and marks, and the description thereon made in the first example similarly apply. In the following description, differences of this fourth example from the first example are mainly explained. There are differences that a window part 4*f* is formed into an oval shape.

As shown in FIG. 6, the dent 4*a* is cut out in the oval shape on the front side of the battery package 1, so that the window part 4*f* is formed.

In this embodiment, since the edge of the window part 4*f* is formed with round curved line, there is less possibility of making cracks from the corners of the window part 4*b* in comparison with that of the first example. As a result, it is possible to reduce occurrence of laceration on finger.

FIFTH EXAMPLE

Figure 7A:
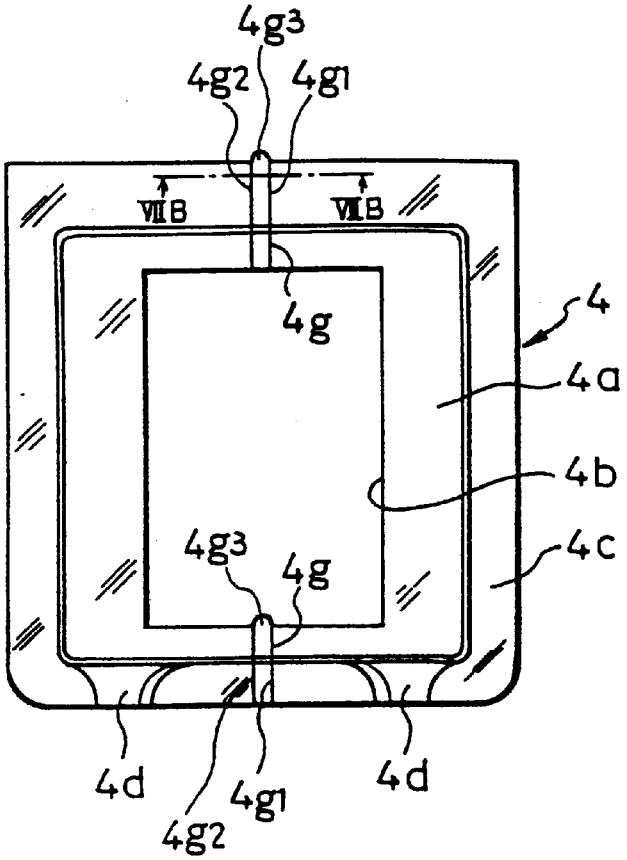
FIG. 7A is a front view showing a holding part of a battery package in a fifth example of the present invention.
Figure 7B:
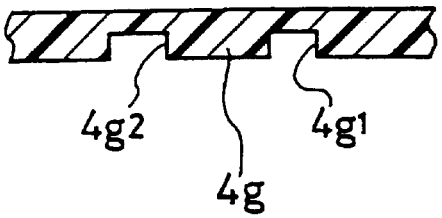
FIG. 7B is an enlarged cross sectional view, which is taken on line VIIB—VIIB, showing the holding part of FIG. 7A.

FIG. 7A is a front view showing a holding part of a battery package in a fifth example of the present invention. FIG. 7B is an enlarged cross sectional view, which is taken on line VIIB—VIIB, showing the holding part of FIG. 7A. In this fifth example, the battery package 1 is fundamentally the same as that of the first example except for the holding part. Therefore, corresponding parts and components to the first example are shown by the same numerals and marks, and the description thereon made in the first example similarly apply. In the following description, differences of this fifth example from the first example are mainly explained. There are difference that a separating part 4*g* is made by forming two narrow gap half cut-out parts 4*g*1 and 4*g*2 with a predetermined distance therebetween on the dent 4*a* and the collar part 4*c* at the upper part of FIG. 7A, and that the similar separating part 4*g* is made also at the lower part.

As shown in FIG. 7A, for example, the half cutout parts 4*g*1 and 4*g*2 are formed on the dent 4*a* and the collar part 4*c* extending between the window part 4*b* and the upper edge of the collar part 4*c*. As shown in FIG. 7B, the half cut-out parts 4*g*1 and 4*g*2 are formed by cutting by half thickness of the holding part 4. As a result, when each protruded parts 4*g*3 of the separating parts 4*g* are pulled away so as to remove the separating part 4*g* from the holding part 4, the packing part 3 can be easily taken out the holding part 4.

The half cut-out parts 4*g*1 and 4*g*2 are formed either on one of the front face or the rear face of the holding part 4. Furthermore, the half cut-out parts 4*g*1 and 4*g*2 may be formed in a perforated shape.

SIXTH EXAMPLE

Figure 8:
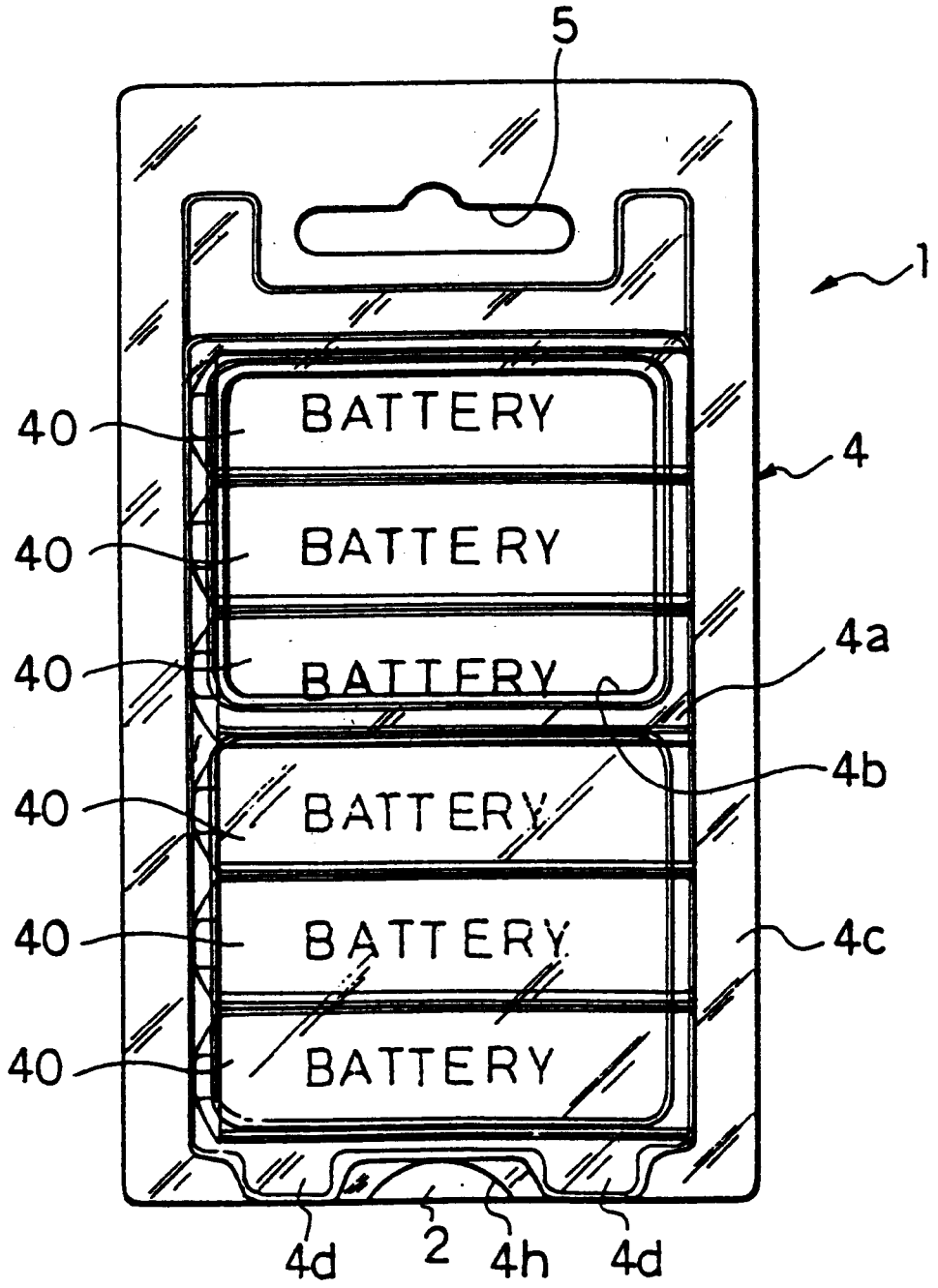
FIG. 8 is a front view of a battery package according to a sixth example of the present invention.
Figure 9:
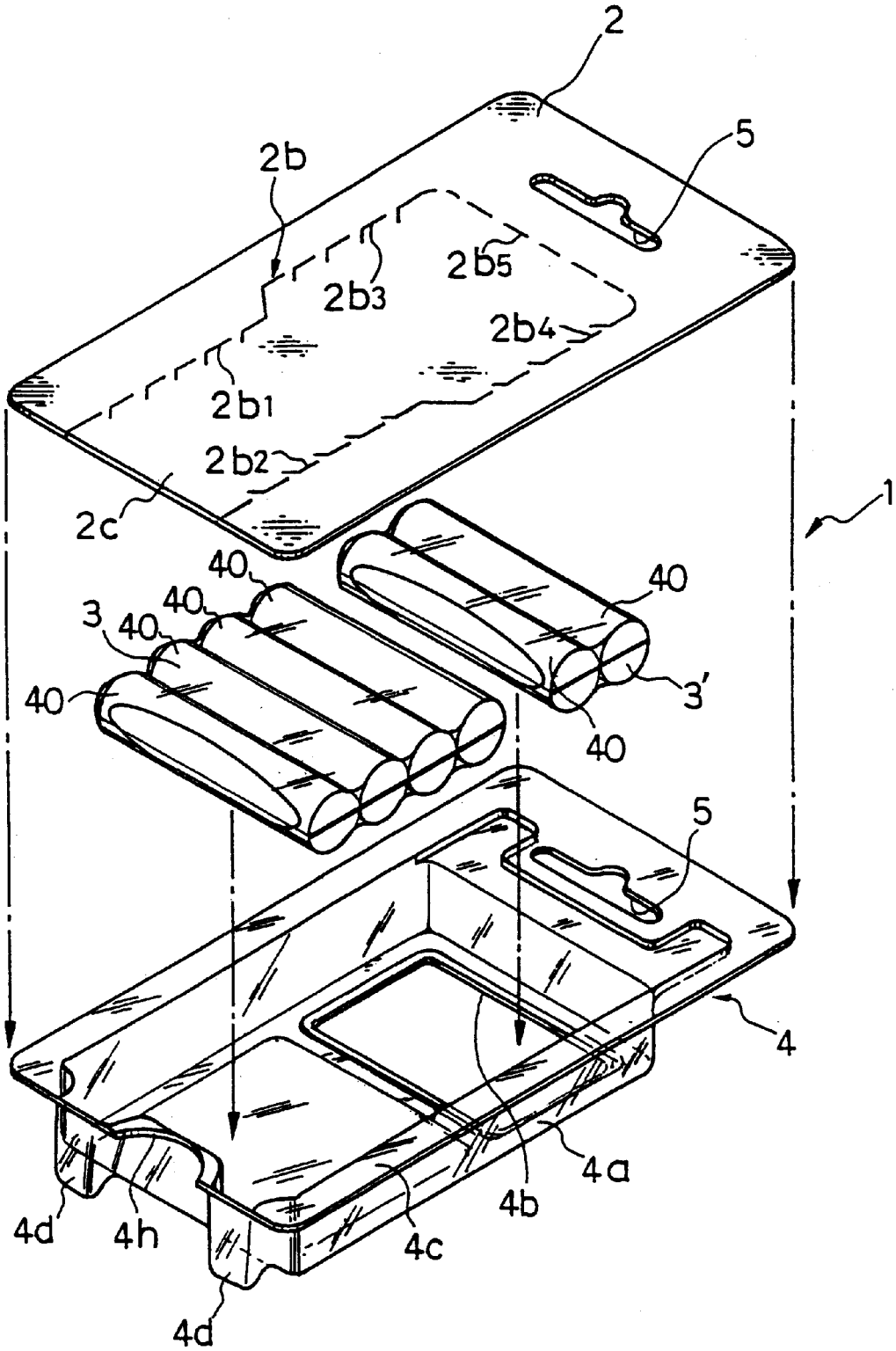
FIG. 9 is an exploded perspective view showing the battery package shown in FIG. 8.

FIG. 8 is a front view of a battery package in a sixth example of the present invention. FIG. 9 is an exploded perspective view of the battery package shown in FIG. 8. In this sixth example, the battery package 1 is fundamentally the same as that of the first example except for the mounting board and the holding part. Therefore, corresponding parts and components to the first example are shown by the same numerals and marks, and the description thereon made in the first example similarly apply. In the following description, differences of this sixth example from the first example are mainly explained. There are differences that a perforation 2*b* having a predetermined configuration is formed in the mounting board 2 and a cut-out part 4*h* is formed in the collar part 4*c* of the holding part 4 which entirely covers the mounting board 2.

In FIG. 8, the holding part 4 entirely covers the mounting board 2, and the mounting board 2 and the collar part 4*c* of the holding part 4 are bonded to each other. In the collar part 4*c*, the cut-out part 4*h* is formed between the pair of the leg parts 4*d*. The cut-out part 4*h* is formed by creating an arc-shaped cutting which opens toward the lower edge of the mounting board 2 in the collar part 4*c*. Furthermore, the cut-out part 4*h* is disposed between the below-mentioned first and second perforations 2*b*1 and 2*b*2 (FIG. 9). A hanging hole 5 is formed in a top end portion of the battery package 1 for hanging the battery package 1 at the store as well as that of the first example. The hanging hole 5 is opened simultaneously on the mounting board 2 and the holding part 4, after each-other bonding the mounting board 2 and the holding part 4.

As shown in FIG. 9, in the mounting board 2, the perforation 2*b* is formed in a predetermined configuration from the lower edge of the mounting board 2. Thereby, the cutting part 2*c* is defined by the perforation 2*b* and the lower edge of the mounting board 2. In the case that the battery package 1 is opened, the cutting part 2*c* is torn away from the mounting board 2 along the perforation 2*b* from the lower edge of the mounting board 2. As has been explained in the above, the cut-out part 4*h* is disposed between the first and the second perforations 2*b*1 and 2*b*2.

Therefore, when the cutting part 2*c* is torn away from the mounting board 2, bending force by finger is like to be given to the first and the second perforations 2*b*1 and 2*b*2 easily. As a result, it is possible to open and take out the battery package 1 easily.

A method of forming the cut-out part 4*h* will be elucidated with reference to FIG. 1A.

Figure 10A:
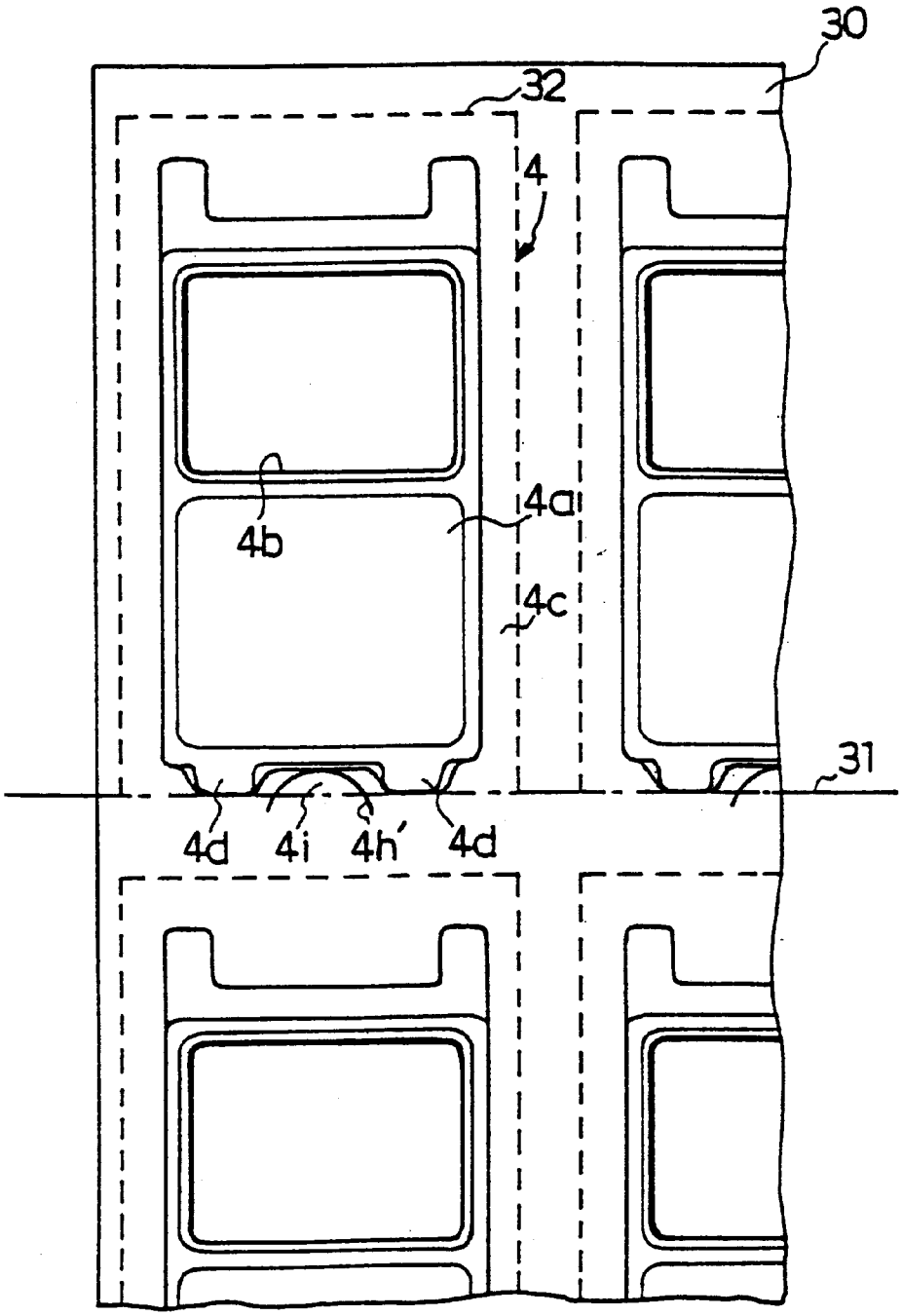
FIG. 10A is an explanatory view showing a method of forming a cut-out part of the battery package shown in FIG. 8.

As shown in FIG. 10A, a plurality of identical metal molds (not shown) are heated and pressed against a synthetic resin sheet 30 having a predetermined size, e.g., 400 mm×270 mm. Thereby the aforementioned dent 4*a*, the window part 4*b* and the pair of the leg parts 4*d* are formed. In the metal molds, sectional shape of it's blade is formed in an arc-shape. Thereby, when the blade penetrates the synthetic resin sheet 30, arc-shaped cuts 4*h*' are formed in the synthetic resin sheet 30.

The holding part 4 is placed downward, and the packing part 3 and 3' are manually put into the dent 4*a* so that the front faces are directed to the front side of the battery package 1. Successively, a mounting board having the same size as the synthetic resin sheet 30 is bonded to the synthetic resin sheet 30 by a hot pressing machine with the heat sensitive and pressure sensitive adhesive.

During bonding of the mounting board and the synthetic resin sheet 30, the adhesive is not supplied to a portion 4*i* disposed between the first and the second perforations 2b1 and 2b2. By cutting the mounting board and the synthetic resin sheet 30 at a dot and dashed line 31 in FIG. 10, the portion 4i is cut off from the collar part 4c, whereby the cut-out part 4h (FIG. 8) is formed in the collar part 4c. The battery package 1 is formed by cutting the mounting board and the synthetic resin sheet 30 at the dot line 32.

Figure 10B:
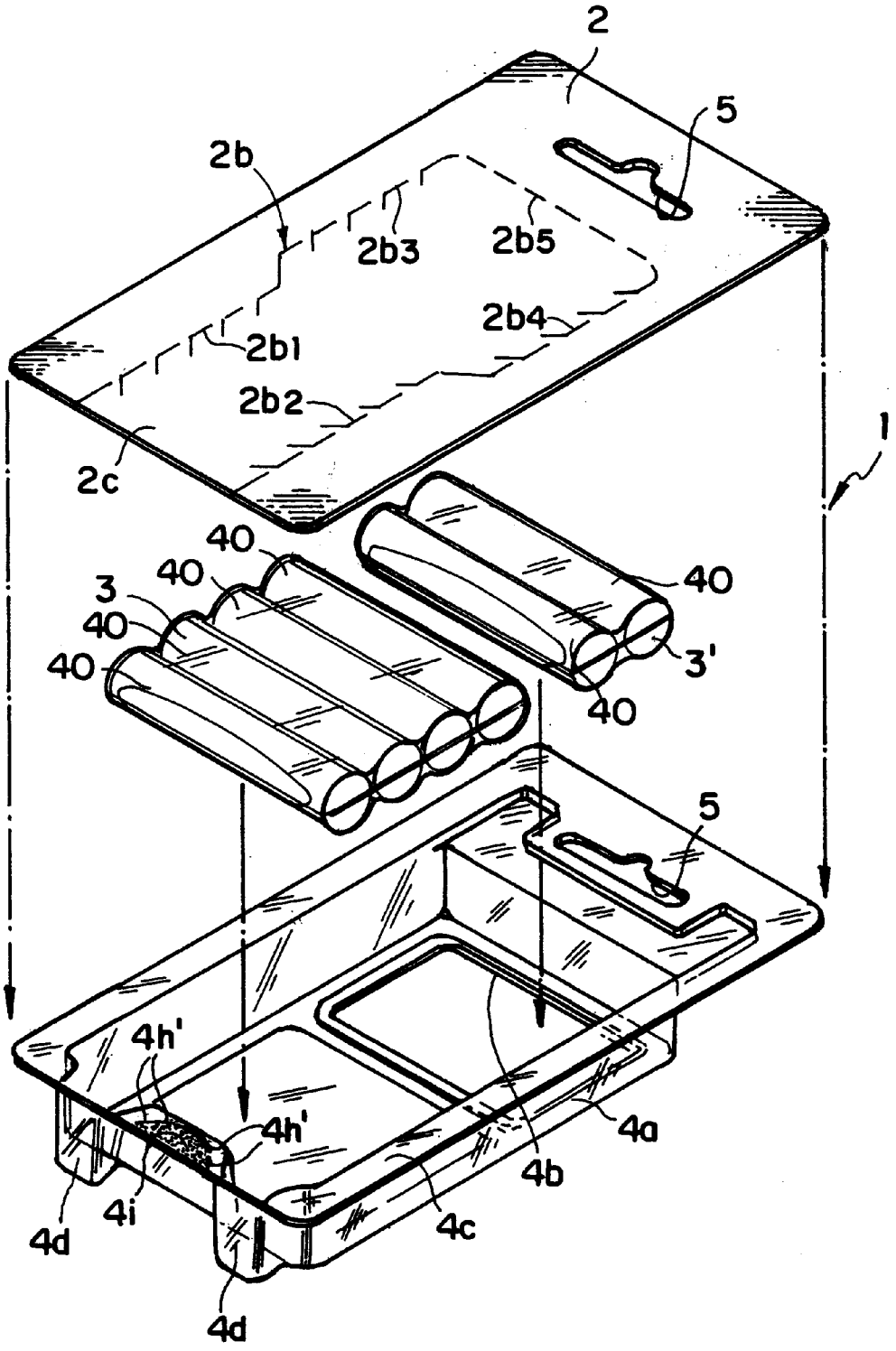
FIG. 10B is an exploded perspective view showing the battery package of an alternative construction of FIG. 10A.
Figure 10C:
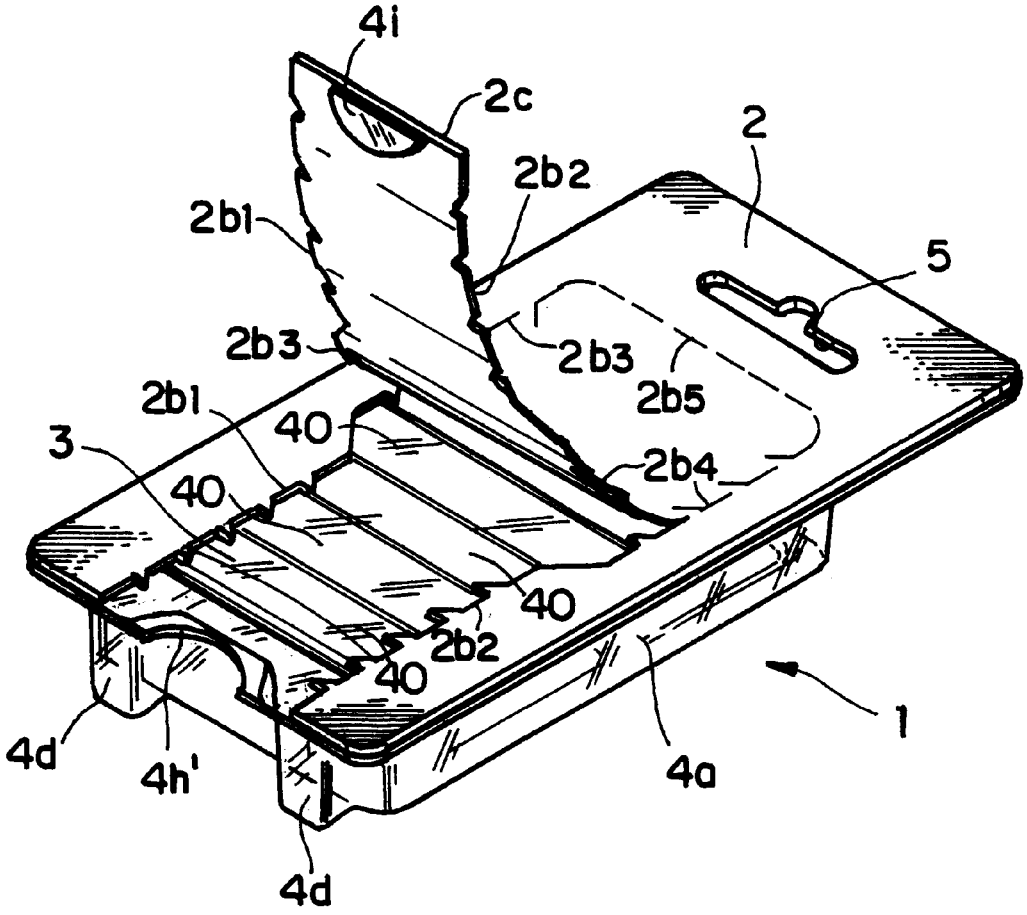
FIG. 10C is a perspective view of the assembled battery package of FIG. 10B showing a peel-away view of the package opening process.

Apart from the aforementioned explanation, wherein the adhesive is not supplied to the portion 4i an alternative construction may be such that the adhesive is supplied to the portion 4i, as shown in FIG. 10B. Thereby, when the battery package 1 is opened, the portion 4i bonded to the mounting board may be cut off from the collar part 4c, so that the cut-out part 4h is formed in the lower end part of the collar part 4c as shown in FIG. 10C. Furthermore, a perforated cut-out portion may be formed instead of the cuts 4h', or a half cut-out part 4h' may be formed by inserting the arc-shaped blade by halfway in the arc-shaped cutting of the thickness of the synthetic resin sheet 30.

The perforation 2b will be elucidated in detail with reference to FIG. 9.

As shown in FIG. 9, the perforation 2b has the first and the second perforations 2b1 and 2b2 disposed parallel to each other and extending from the lower edge of the mounting board 2, a third and a fourth perforations 2b3 and 2b4 disposed parallel to each other, and a fifth perforation 2b5 disposed parallel to the lower edge of the mounting board 2. One ends of the third and the fourth perforations 2b3 and 2b4 are connected to the first and the second perforations 2b1 and 2b2, respectively. The other ends of the third and the fourth perforations 2b3 and 2b4 are connected to one end and the other end of the fifth perforation 2b5, respectively. Distance between the first and the second perforations 2b1 and 2b2 is smaller than opening width of the opening of the dent 4a of the holding part 4. Distance between the third and the fourth perforations 2b3 and 2b4 is substantially the same as the opening width of the opening of the dent 4a. Therefore, even after opening of the battery package 1, as shown in FIG. 11 for example, four unused batteries 40 are held between the dent 4a and protruded parts 2d and 2d' of the mounting board 2 which are left uncutting part.

As has been explained in the above, in the battery package 1 of the present example, the two perforations 2b1 and 2b2 are formed with a predetermined distance therebetween on the mounting board 2 extending from one edge to the other edge of the mounting board 2. Furthermore, the cut-out part 4h opening toward the one edge of the mounting board 2 is formed in the collar part 4c between the two perforations 2b1 and 2b2. Accordingly, it is possible that the two perforations 2b1 and 2b2 are torn away only by giving a moderate force on such part of the mounting board 2 that faces to the cutout part 4h. As a result, the battery package 1 can be opened easily.

As has been explained in the above, the distance between two perforations 2b1 and 2b2 is smaller than the opening width of the opening of the dent 4a. Thereby, when the battery package 1 is opened by cutting the mounting board 2 along the perforations 2b1 and 2b2, it is possible to keep the batteries 40 between the dent 4a and the protruded parts 2d and 2d' of the mounting board 2 left uncutting part.

SEVENTH EXAMPLE

FIG. 12 is a rear view showing a battery package in a seventh example of the present invention. FIG. 13A is a rear view showing a state after opening the battery package of FIG. 12. FIG. 13B is a side view showing a state after opening the battery package of FIG. 12. In this seventh example, the battery package 1 is fundamentally the same as that of the sixth example except for the mounting board. Therefore, corresponding parts and components to the sixth example are shown by the same numerals and marks, and the description thereon made in the sixth example similarly apply. In the following description, differences of this seventh example from the sixth example are mainly explained. There are such differences that the first perforation 2b1 is formed in a line from the lower edge of the mounting board 2 to an upper edge of the opening of the dent 4a, and that a thin part 2e is formed from the fourth perforation 2b4 to the lower edge of the mounting board 2.

As shown in FIG. 12, the first perforation 2b1 is formed between the lower edge of the mounting board 2 and the upper edge of the opening of the dent 4a (FIG. 9). The first perforation 2b1 is connected to the fifth perforation 2b5. As a result, even after opening of the battery package 1, an area of the protruded part 2d is larger than that of the sixth example. Thereby, it is possible to improve the maintainability of unused batteries 40.

Furthermore, the thin part 2e is formed on the protruded part 2d' parallel to the second perforation 2b2 between the lower edge of the mounting board 2 and the fourth perforation 2b4. The thin part 2e is formed on the protruded part 2d' by pressing so as to be easily bend the protruded part 2d' toward the inside the dent 4a. When unused batteries 40 are packed into the dent 4a, as shown in FIGS. 13A and 13B, the thin part 2e is bent toward inside of the dent 4a by contacting the side surfaces of the batteries 40 with the edge of the protruded part 2d'. Thereby, it is possible to prevent the batteries 40 from moving in the vertical direction within the battery package 1 during storing of the batteries 40.

Furthermore, it is possible to keep the batteries 40 more stably than that of the sixth example.

EIGHTH EXAMPLE

FIG. 14 is a rear view showing a battery package in an eighth example of the present invention. In this eighth example, the battery package 1 is fundamentally the same as that of the sixth example except for the mounting board. Therefore, corresponding parts and components to the sixth example are shown by the same numerals and marks, and the description thereon made in the sixth example similarly apply. In the following description, differences of this eighth example from the sixth example are mainly explained. There are differences that the first and the second perforations 2b1 and 2b2 are formed ranging from the lower edge of the mounting board 2 to the upper edge of the opening of the dent 4a (FIG. 9) without the third and the fourth perforations 2b3 and 2b4 shown in FIG. 9.

As shown in FIG. 14, the first and the second perforations 2b1 and 2b2 extend up to the upper edge of the opening of the dent 4a from the lower edge of the mounting board 2. The first and the second perforations 2b1 and 2b2 are connected to the fifth perforation 2b5. As a result, when the battery package 1 is opened, the areas of the protruded parts 2d and 2d' are larger than those of the sixth example.

The battery package 1 is deformed in V-shape as viewed from above in so that a central portion of the front surface of the battery package 1 is a dent inside the deformed V-shape, thereby temporarily increasing the distance between the two protruded parts 2d and 2d'. As a result, the batteries 40 are taken out the battery package 1 and unused batteries 40 are packed in the battery package 1.

NINTH EXAMPLE

FIG. 15A is a perspective view showing a battery package in a ninth example of the present invention. FIG. 15B is a cross sectional view, which is taken on line XVB—XVB, showing the battery package of FIG. 15A. In this ninth example, the battery package 1 is fundamentally the same as that of the sixth example except for the mounting board. Therefore, corresponding parts and components to the sixth example are shown by the same numerals and marks, and the description thereon made in the sixth example similarly apply. In the following description, differences of this ninth example from the sixth example are mainly explained. In FIGS. 15A and 15B, illustration of the packing part 3 is omitted for the sake of simplicity of drawings. There are differences that a first half cut-out part 2*f*1 and a second half cut-out part 2*f*2 are formed on the mounting board 2. The size of the mounting board is larger than the size of the outer circumference of the collar part 4*c*.

As shown in FIGS. 15A and 15B, the first half cut-out part 2*f*1 is formed on the mounting board 2 at a position between the lower edge of the mounting board 2 and the lower edge of the collar part 4*c*, across the first and the second perforations 2*b*1 and 2*b*2 Similarly, the second half cut-out part 2*f*2 is formed on the mounting board 2 along the inner edge of the collar part 4*c* across the third and the fourth perforations 2*b*3 and 2*b*4. Thereby, when the cutting part 2*c* is torn away from the mounting board 2, the cutting part 2*c* is separated into two parts at the part underneath the collar part 4*c* at the part between the first and the second half cut-out parts 2*f*1 and 2*f*2 in thickness direction of the mounting board 2. That is, a first separated part is a face part of the mounting board 2 bonded to the lower surface of the collar part 4*c*. The other separated part is a part which comes apart from the collar part 4*c* by peeling off the face part of the mounting board 2. Since the second half cut-out part 2*f*2 is formed inside the collar part 4*c*, it is easy to remove the cutting part 2*c*, and open the battery package 1.

Furthermore, a cut-out part 4*h* as shown in FIG. 8 may be formed on the collar part 4*c* at the part between the first and the second half cut-out parts 2*f*1 and 2*f*2.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure.

Accordingly, it is intended that the appended claims be interpreted as covering all alterations and modifications as fall within the true spirit and scope of the invention.

What is claimed is:

1. A merchandise package comprising:

(a) a mounting board having first and second opposite side edges and a third edge extending therebetween, the mounting board including two perforations formed therein which extend away from the third edge into the mounting board, a peripheral region being defined between each of the perforations and the respective first and second opposite side edges; and (b) a holding part for holding at least one article in cooperation with the mounting board, the holding part including:

(i) a dent for containing the at least one article, and (ii) a collar part to be bonded to the mounting board in at least the peripheral region, the collar part including a cut line which defines a detachable portion of the collar part so that both ends of the cut line are connected with a lower edge of the collar part, the cut line being located between the two perforations at the lower edge of the collar part, the detachable portion also being directly bonded to the mounting board, the cut line allowing the detachable portion to release from the collar part and remain bonded to the mounting board when the merchandise package is opened, wherein release of the detachable portion from the collar part causes a cut-out part to be formed in a lower end part of the collar part, and wherein a portion of the mounting board between the two perforations separates from the holding part in one peel away motion and the peel away motion opens the holding part for access to the at least one article therein, and wherein the two perforations have a predetermined distance therebetween ranging from one edge toward the other edge of the mounting board, the predetermined distance along at least a portion of the mounting board being smaller than an opening width of the dent.

2. A merchandise package according to claim 1 wherein the cut line and the resultant cut-out part are arc-shaped.

3. A merchandise package according to claim 1 wherein the third edge is a lower edge of the mounting board, and the two perforations are disposed parallel to each other and extend away from the third edge.

4. A merchandise package according to claim 1 further comprising:

(c) a pair of leg parts disposed at a lower end of the dent so that a bottom surface of each of the leg parts is flush with the third edge of the mounting board.

5. A merchandise package comprising:

(a) a mounting board; and (b) a holding part adapted to be bonded to the mounting board for holding at least one article in cooperation with the mounting board, the holding part including (i) a dent for containing the at least one article, and (ii) a collar part, the collar part including a cut line which defines a detachable portion of the collar part, the cut line being located so that both ends of the cut line are connected with a lower edge of the collar part at predetermined distances from respective side edges of the collar part, the detachable portion being located at a lower edge of the collar part, the detachable portion being bonded directly to the mounting board, the cut line allowing the detachable portion to release from the collar part and remain bonded to the mounting board when the merchandise package is opened, wherein release of the detachable portion from the collar part causes a cut-out part to be formed in a lower end part of the collar part, and wherein a portion of the mounting board separates from the holding part in one peel away motion and the peel away motion opens the holding part for access to the at least one article held therein, and wherein two perforations are formed in the mounting board with a predetermined distance therebetween ranging from one edge toward the other edge of the mounting board, the predetermined distance along at least a portion of the mounting board being smaller than an opening width of the dent.

6. A merchandise package according to claim 5 wherein the cut line and the resultant cut-out part are arc-shaped.

7. A merchandise package according to claim 5 wherein the entire collar part is bonded to the mounting board.

8. A merchandise package according to claim 5 wherein the mounting board includes two perforations which extend away from a lower edge of the mounting board and define a region which is released from the mounting board when the merchandise package is opened, the detachable portion of the collar part remaining bonded to the released region of the mounting board when the merchandise package is opened.

9. A merchandise package according to claim 5 wherein the holding part includes a dent and the merchandise package further comprises:

(c) a pair of leg parts disposed at a lower end of the dent so that a bottom surface of each of the leg parts is flush with a lower edge of the mounting board.

* * * * *